United States Patent [19]

Sterne

[11] 4,005,675

[45] Feb. 1, 1977

[54] MACHINE FOR TRIMMING A COPY SHEET AND APPLYING ADHESIVE THERETO

[76] Inventor: Harold E. Sterne, 5815 Cherokee Drive, Madeira, Ohio 45243

[22] Filed: Mar. 22, 1976

[21] Appl. No.: 669,168

[52] U.S. Cl. ..... 118/38; 118/261

[51] Int. Cl.[2] ..... B05C 1/02

[58] Field of Search ..... 118/38, 39, 261, DIG. 17, 118/245, 249, 236

[56] References Cited

UNITED STATES PATENTS

| | | | |
|---|---|---|---|
| 834,087 | 10/1906 | Vogt | 118/38 |
| 2,590,339 | 3/1952 | Minkow | 118/261 X |
| 2,614,521 | 10/1952 | Eida | 118/39 X |
| 3,315,636 | 4/1967 | Lester et al. | 118/261 X |

*Primary Examiner*—John P. McIntosh
*Attorney, Agent, or Firm*—James W. Pearce; Roy F. Schaeperklaus

[57] ABSTRACT

A machine for trimming edges from a sheet of copy and for applying adhesive to a back face of the sheet. The sheet crosses an entry table and is guided to a backup roll. Spaced knives trim edges of the sheet as the sheet passes over the backup roll. The trimmed sheet is received by a guide which directs the sheet to an adhesive applying roll. A metering blade controls the amount of adhesive on the adhesive applying roll. The guide rests on the backup roll and on the metering blade, and the metering blade directs the sheet to the adhesive applying roll so that the trimmed sheet receives adhesive on a back face thereof.

7 Claims, 10 Drawing Figures

MACHINE FOR TRIMMING A COPY SHEET AND APPLYING ADHESIVE THERETO

This invention relates to a machine for use in forming a paste-up for printing copy for printing. More particularly, this invention relates to a machine for trimming edges of a copy sheet bearing printing and for applying adhesive to a rear face thereof.

In the preparing of copy, particularly in phototypesetting one of the more tedious tasks consists of trimming edges of a paper sheet bearing copy produced by a phototypesetting machine and the applying of adhesive to the back of the sheet as required for paste-up. An object of this invention is to provide a machine which automatically trims edges of such a copy sheet and applies adhesive to the back thereof.

A further object of this invention is to provide such a machine which includes an adhesive applying roll and a metering blade for regulating the thickness of the adhesive layer on the adhesive applying roll together with means for varying the spacing between the adhesive applying roll and the metering blade which is on the outside of the machine.

A further object of this invention is to provide a machine of this type in which there is a sheet guide which receives a sheet from knives which trim edges of the sheet and directs the sheet over the metering blade to the adhesive applying roll.

The above and other objects and features of the invention will be apparent to those skilled in the art to which this invention pertains from the following detailed description and the drawings, in which.

In the following detailed description and the drawings, like reference characters indicate like parts.

Figure 1:
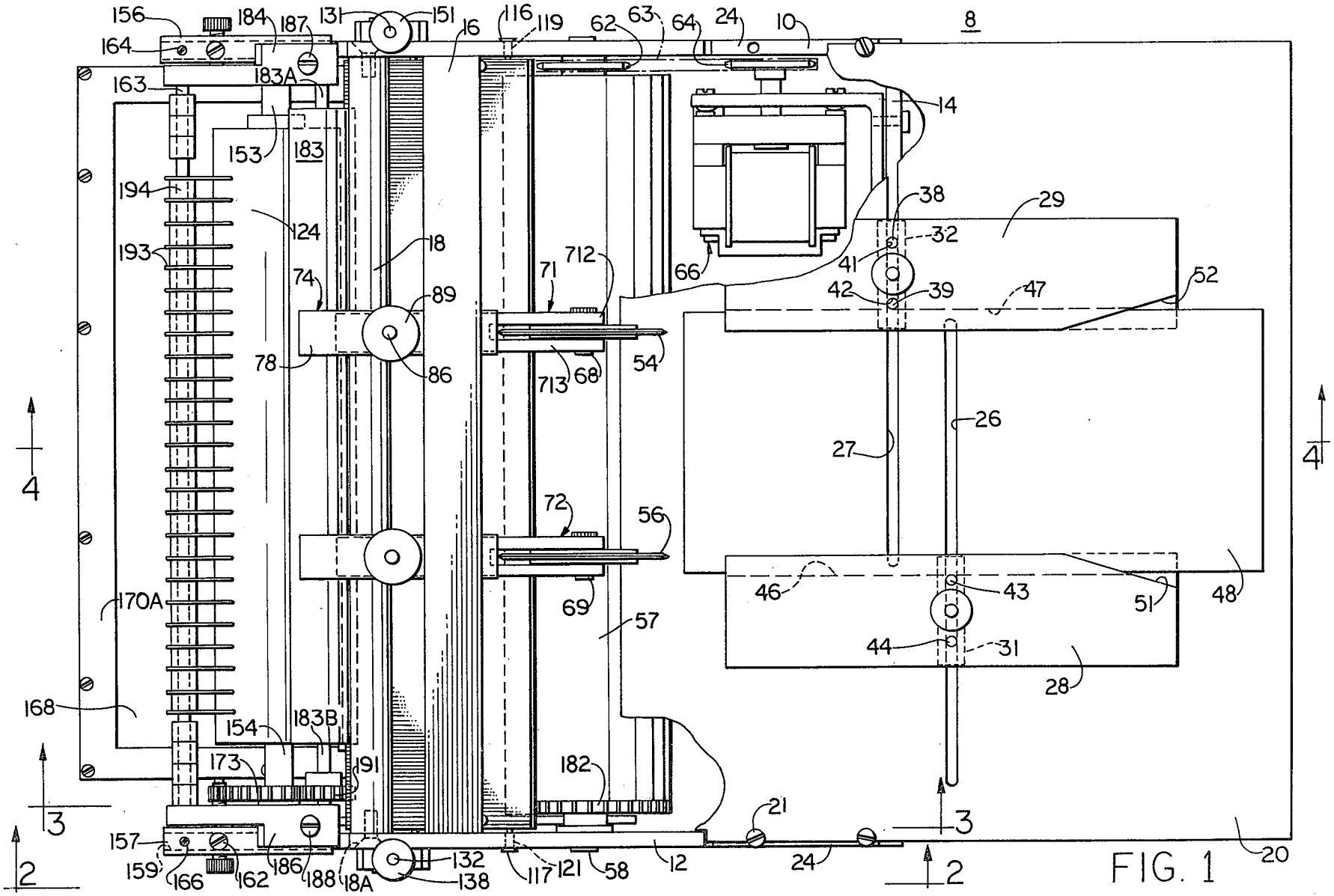
FIG. 1 is a top plan view of a machine constructed in accordance with an embodiment of this invention, a brush assembly being removed and parts being broken away to reveal details of construction.
Figure 2:
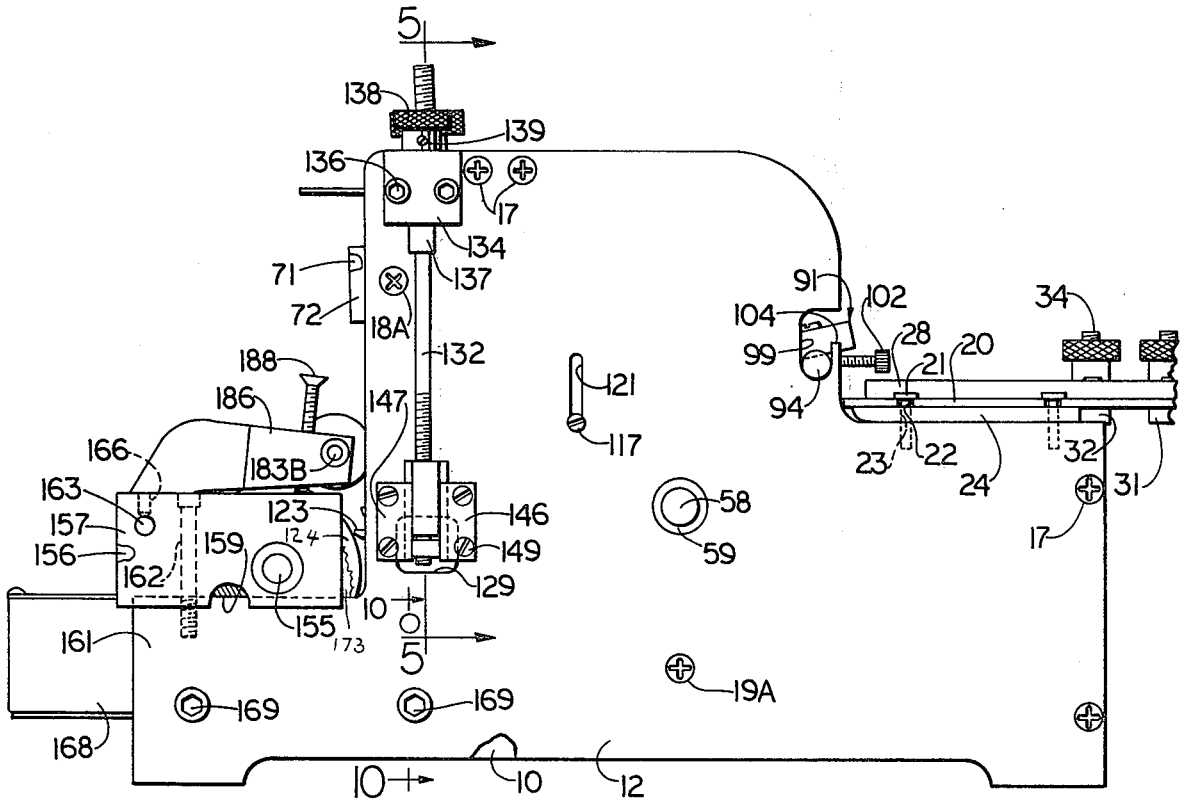
FIG. 2 is a fragmentary view in side elevation of the machine illustrated in FIG. 1 looking in the direction of the arrows 2—2 in FIG. 1 with the brush assembly being shown in position.

In FIG. 1 is shown a machine 8 constructed in accordance with an embodiment of this invention. The machine 8 includes upright side plates 10 and 12 which are held in parallelism by a cross plate 14 and a cross bar 16 which span the side plates 10 and 12 and are attached thereto by appropriate fasteners 17 (FIG. 2). A transverse shaft 18 (FIGS. 1, 3 and 4) and a transverse rod 19 (FIGS. 3 and 4) also span the side plates 10 and 12. The shaft 18 is carried by fasteners 18A, one of which is shown in FIG. 2, mounted in the side plates. The shaft 19 is carried by fasteners 19A, one of which is shown in FIG. 2, mounted in the side plates. A horizontal entry table 20 is mounted on the side plates 10 and 12 by means of fasteners 21. The fasteners 21 extend through slots 22 (FIG. 2) in the table 20 and through upright bores 23 in shims 24, which determine the height of the table 20.

The table 20 is provided with transverse slots 26 and 27 (FIG. 1). Side guides 28 and 29 are mounted on the table 20 above the slots 26 and 27, respectively. Brackets 31 and 32 position the side guides 28 and 29, respectively. The brackets 31 and 32 are similar in construction, and only the bracket 32 will be described in detail. Bracket 32 includes a plate portion 33 (FIG. 4), which underlies the table 20, and a threaded stud 34, which extends upwardly through the slot 27 and carries a nut 36. The nut 36 serves to lock the bracket 32 and the side guide 29 in position. Pins 38 and 39 (FIG. 1) mounted in upright bores 41 and 42, respectively, in the side guide 29 extend into the slot 27 to prevent turning of the side guide 29. Pins 43 and 44 mounted in the side guide 28 and extending into the slot 26 prevent turning of the side guide 28. The side guides 28 and 29 are provided with lengthwise opposed, parallel inwardly opening slots 46 and 47, respectively, for receiving edges of a sheet 48 of copy for guiding the sheet 48 as the sheet 48 travels across infeed table 20. Portions of the side guides 28 and 29 overlying outer portions of the slots 46 and 47 are cut away as indicated at 51 and 52, respectively, to permit ready insertion of edge portions of the sheet 48.

The entry table 20 and the side guides 28 and 29 direct the sheet 48 under cutting knives 54 and 56 and over a backup roll 57 in properly centered position for trimming appropriate strips from the sheet 48 along lengthwise edge portions of the sheet 48. The backup roll 57 is mounted on a cross shaft 58. The shaft 58 is rotatably mounted in bearings 59 carried by the side plates 10 and 12, one of which is shown in FIG. 2. The shaft 58 carries a sprocket 62 (FIGS. 1 and 4) which is driven by a chain 63. The chain 63 is driven by a sprocket 64 which, in turn, is driven by an appropriate drive motor and gear box assembly 66 that is mounted on the cross plate 14.

Figure 8:
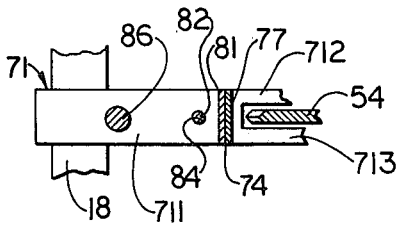
FIG. 8 is a view in section taken on the line 8—8 in FIG. 4.

The knives 54 and 56 are rotatably supported on pins 68 and 69 carried by brackets 71 and 72, respectively. Each of the brackets 71 and 72 is rotatably mounted on the transverse shaft 18. The brackets 71 and 72 are similar in structure, and only the bracket 71 and associated structure will be described in detail. The bracket 71 includes a body 711 and bifurcations 712 and 713 between which the pin 68 is mounted. The bracket 71 (FIG. 4) is urged downwardly by a compression coil spring 73 and a leaf spring 74. The leaf spring 74 is generally L-shaped and includes a downwardly directed arm 77 and a generally horizontal arm 78. A lower end portion of the arm 77 is received in a slot 79 in the body 711 and is held in place in the slot 79 by a filler plate 81. The compression spring 73 is mounted on a pin 82. The pin 82 is mounted in a socket 84 (FIG. 8) in the body 711 of the bracket 71. The arm 78 (FIG. 4) of the leaf spring 74 engages the underside of the cross bar 16, and the compression spring 73 bears on the arm 78 of the leaf spring 74 underlying the cross bar 16. The compression spring 73 also bears on the body 711 of the bracket 71 to normally urge the bracket 71 clockwise to urge the knife 54 into sheet slitting relationship with the backup roll 57. A threaded stud 86 is mounted in a socket 87 (FIG. 4) in the body 711 of the bracket 71. The stud 86 extends through an upright bore 88 in the arm 78 of the leaf spring 74. A nut 89 is threaded on the stud 86 and can be turned to urge the spring arm 78 downwardly to cause release of the spring arm 78 from the cross bar 16 and cause release of the knife 54 from the backup roll 57 so that the knife 54 and the bracket 71 can be slid along the shaft 18 for adjusting the position of the knife 54. When the knife 54 has been moved to adjusted position, the nut 89 can be turned in the opposite direction to release the spring arm 78 so that the spring arm 78 again engages the cross bar 16 and the springs 73 and 74 urge the knife 54 into sheet slitting relation with the backup roll 57.

Figure 9:
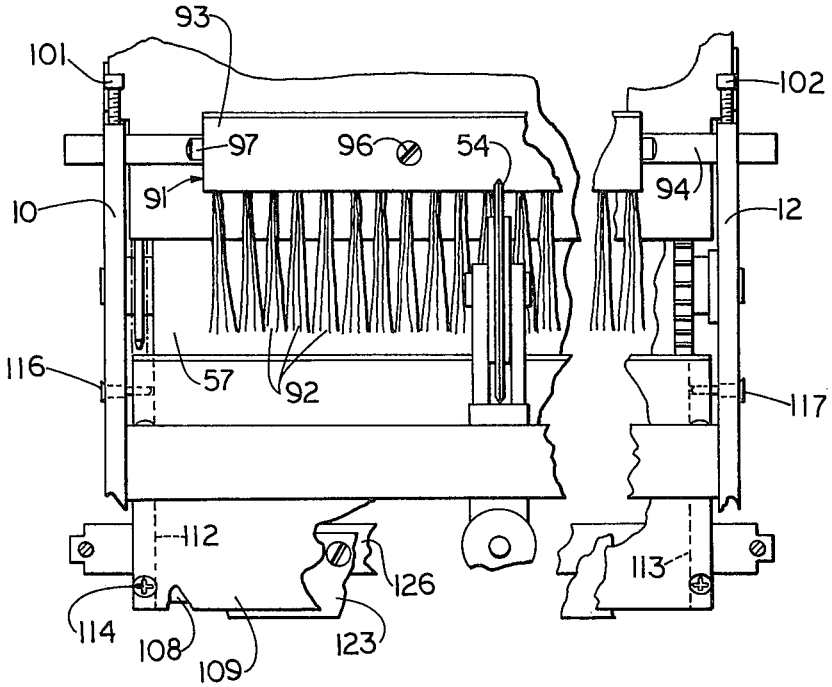
FIG. 9 is a fragmentary plan view of the machine with the brush assembly in position, parts being broken away to reveal details of construction.

As the sheet 48 (FIG. 1) advances across the entry table 20 and passes beneath the knives 54—56, a brush 91 (FIGS. 4 and 9) directs the sheet into flatwise relation with the face of the backup roll 57. The brush 91 includes bristles 92 mounted in a backing bar 93. The backing bar 93 is mounted on a cross rod 94 by means of fasteners 96. The cross rod 94 is provided with a flat face portion 97 which engages the backing bar 93. End portions of the cross rod 94 are received in slots 98 (FIG. 3) and 99 (FIG. 2) in the side plates 10 and 12, respectively. Fasteners 101 and 102 (FIG. 9) threaded in lugs 103 (FIG.3) and 104 (FIG. 2) hold the cross rod 94 and the brush 91 in position.

Figure 3:
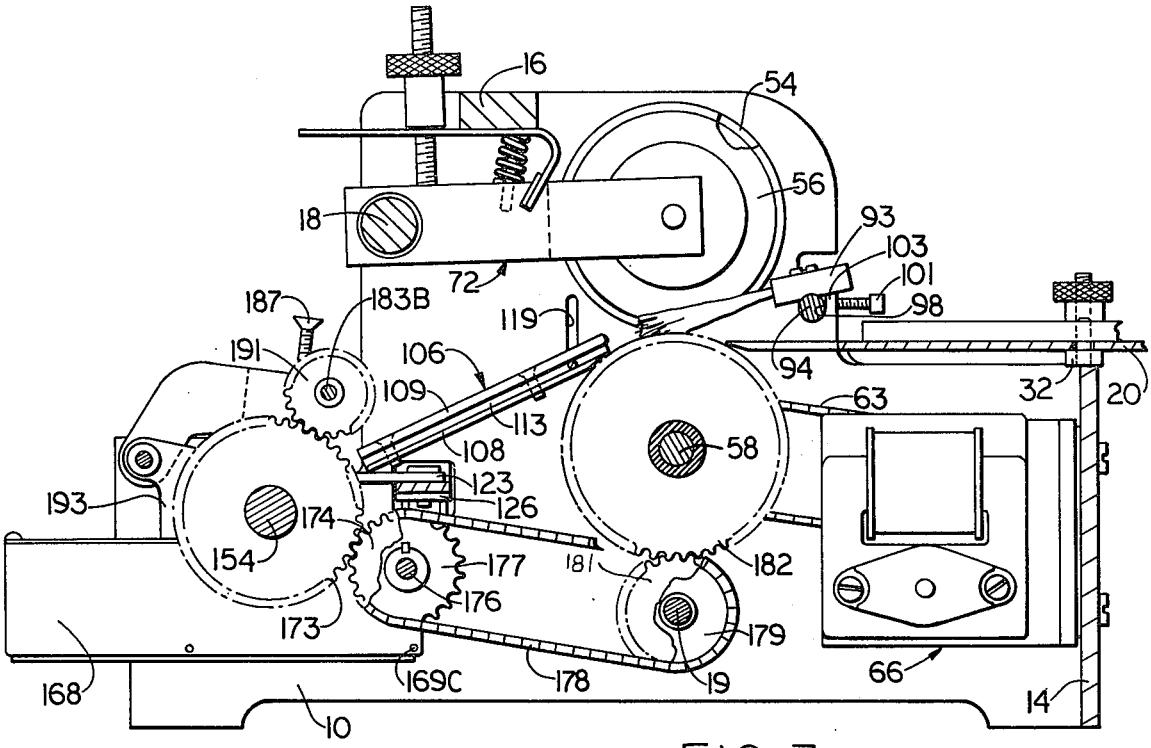
FIG. 3 is a view in section taken on the line 3—3 in FIG. 1.

The brush 91 directs the sheet 48 into a guide assembly 106 (FIG. 3) after edge portions of the sheet have been separated from a main portion thereof by the knives 54 and 56. The guide assembly 106 includes a lower plate 108 and an upper plate 109 which define a slot 111 (FIG. 4) therebetween. The upper plate 109 can be of transparent material so that the sheet 48 can be observed as it passes through the guide assembly 106. Edge portions of the plates 108 and 109 are separated by spacer strips 112 (FIG. 4) and 113 (FIG. 3). Fasteners 114 (FIG. 9) hold the plates 108 and 109 and the spacer strips 112 and 113 in assembled relation. The guide assembly 106 is held in position by fastener elements 116 and 117, which are mounted in the spacer strips 112 and 113, respectively, adjacent an upper edge portion of the plate 108. The fastener elements 116 and 117 are slideably mounted in upright slots 119 (FIG. 1) and 121 in the side plates 10 and 12, respectively. Sides of the slots 119 and 121 form tracks guiding the fastener elements 116 and 117 for up and down movement to guide the upper edge portion of the plate 108 into position for engaging the backup roll 57. The upper edge portion of the plate 108 (FIG. 4) conforms to the face of the backup roll 57 and rests against the backup roll 57 in position to guide the sheet 48 into the slot 111. A lower edge portion of the plate 108 rests on a plate or blade 123, which guides the sheet 48 to an adhesive applying roll 124.

Figure 5:
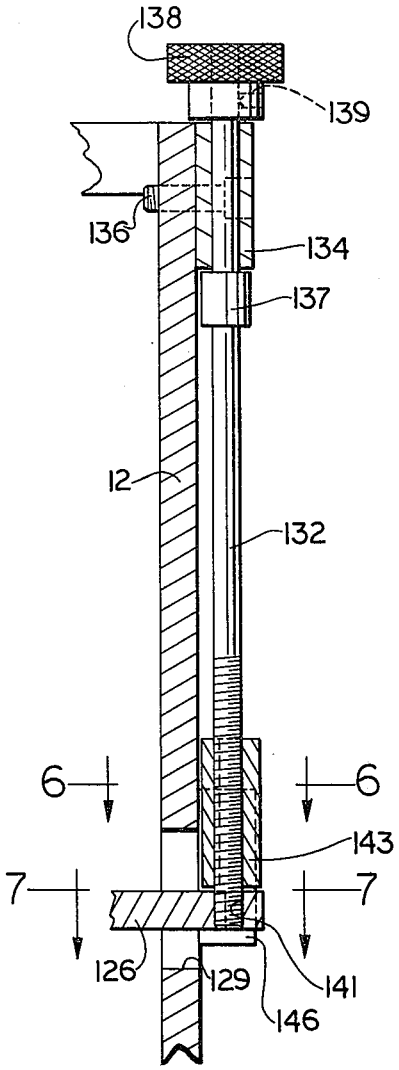
FIG. 5 is a view in section taken on the line 5—5 in FIG. 2 on an enlarged scale.
Figure 6:
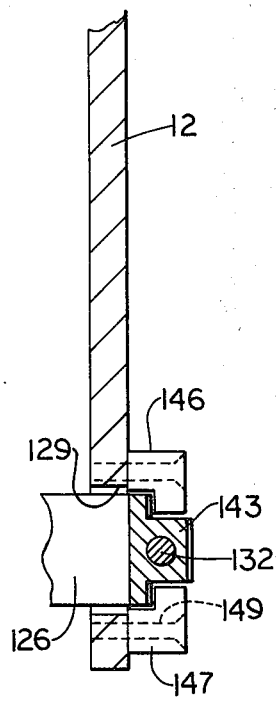
FIG. 6 is a view in section taken on the line 6—6 in FIG. 5.
Figure 7:
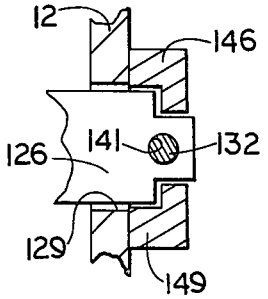
FIG. 7 is a view in section taken on the line 7—7 in FIG. 5.

The plate 123 is carried on a blade supporting cross bar 126. End portions of the cross bar 126 extend through openings 128 (FIG. 4) and 129 (FIGS. 2 and 5) in the side plates 10 and 12, respectively. The end portions of the cross bar 126 are supported by upright hanger rods 131 and 132 (FIG. 1). The hanger rods 131 and 132 are similar in construction and operation, and only the rod 132 and associated elements will be described in detail. The rod 132 is rotatably mounted in a hanger supporting bearing block 134, which is attached to the side plate 12 by fasteners 136 (FIGS. 2 and 5). A collar 137, which is integral with the rod 132, and a knurled ring member 138 bear on the bearing block 134 to prevent up and down movement of the rod 132. A set screw 139 mounted in the ring member 138 holds the ring member 138 in position on the rod 132. A lower end portion of the rod 132 is threaded in an upright bore 141 (FIG. 5) in the cross bar 126 adjacent an end thereof. A guide element 143 is threadably mounted on the rod 132 above the cross bar 126. The guide element 143 runs between tracks 146 and 147 (FIG. 6) to steady the rod 132 and the end of the cross bar 126. The tracks 146 and 147 are attached to the side plate 12 by fasteners 149. The knurled ring member 138 can be turned to cause raising and lowering of the end of the cross bar 126 adjacent the bore 141. Thus, turning of the ring member 138 and of a similar ring member 151 (FIG. 1) mounted on the rod 131 makes possible raising and lowering of the plate 123 (FIGS. 2 and 3) so that the plate 123 can be aligned with the axis of the roll 124 and can be positioned at a proper height to meter the adhesive pick-up by the roll 124 and to guide the sheet 48 to the roll 124. The ring members 138 and 151 are readily accessible and the blade moving structure is outboard of the side plates 10 and 12.

The roll 124 includes stub shaft portions 153 and 154 (FIG. 1). End portions 155 of the stub shaft portions, one of which is shown in FIG. 2, are rotatably mounted in bearing blocks 156 and 157. The bearing blocks 156 and 157. The bearing blocks 156 and 157 are mounted on the side plates 10 and 12, respectively. Each of the bearing blocks 156 and 157 is provided with a slot 159, one of which is shown in FIG. 2. An upper edge of a horizontal portion 161 of the associated side plate is received in the slot 159. A fastener 162 holds the associated bearing block 157 on the associated side plate 12. A cross rod 163 connects the bearing blocks 156 and 157. Set screws 164 and 166 mounted in the bearing blocks 156 and 157, respectively, hold the bearing blocks 156 and 157 in spaced relation on the cross rod 163.

Figure 4:
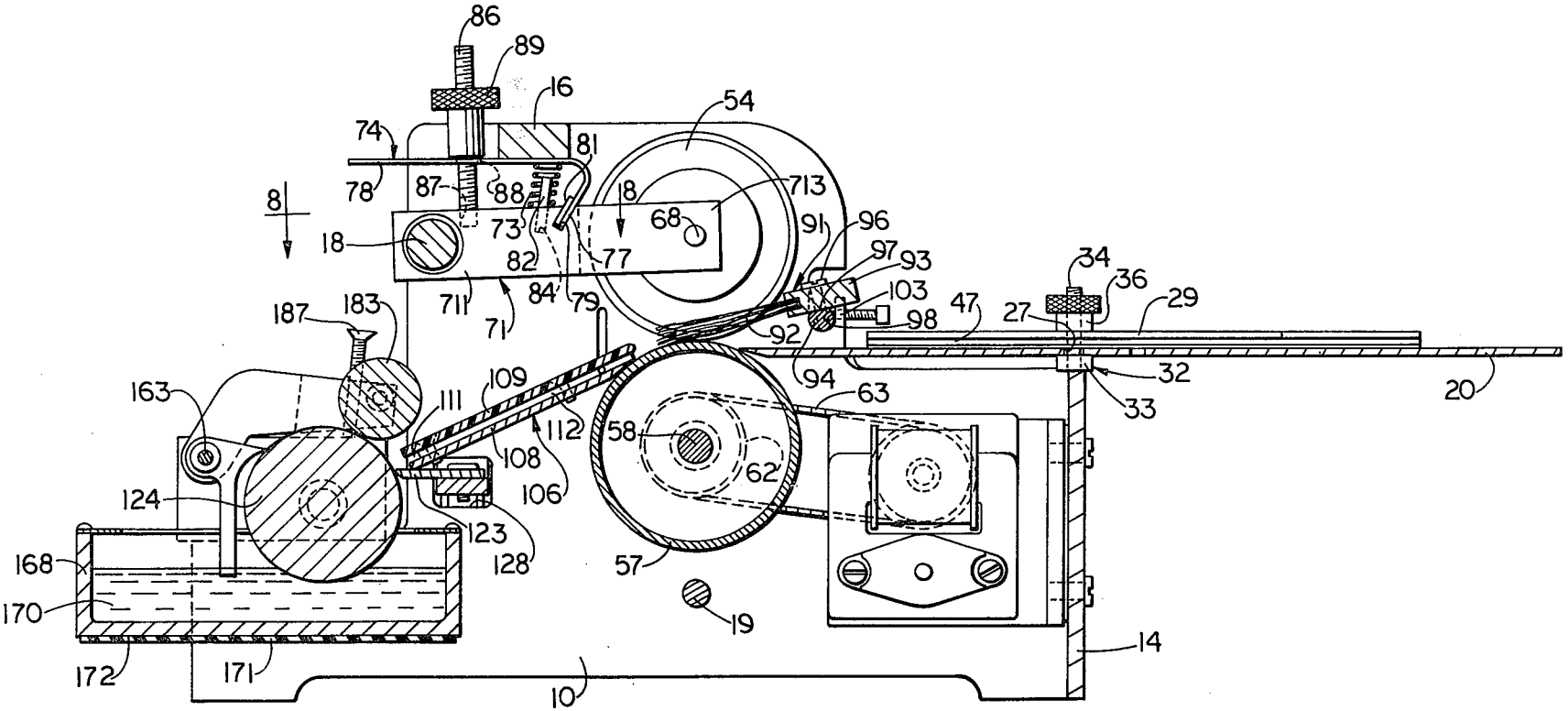
FIG. 4 is a view in section taken on the line 4—4 in FIG. 1.
Figure 10:
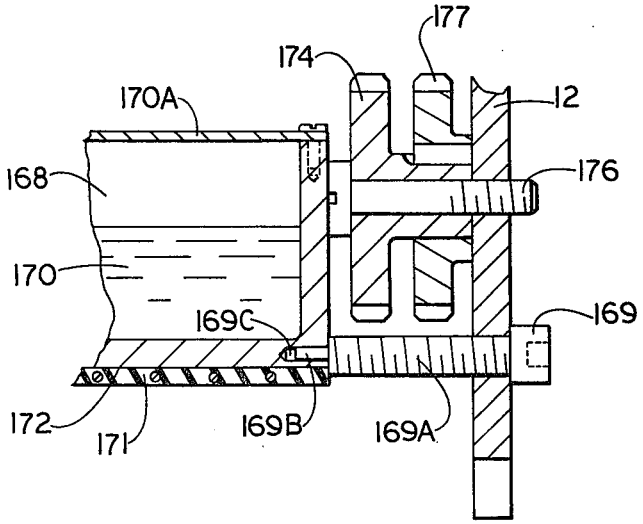
FIG. 10 is a view in section taken on the line 10—10 in FIG. 2.

A lower portion of the roll 124 runs in an opentopped pan 168, as shown in FIG. 4. The pan 168 is supported on fastener elements 169. Details of construction of one of the fastener elements 169 are shown in FIG. 10. A shank 169A of the fastener element 169 is threaded in the side wall 12. A cylindrical end portion 169B of the fastener element 169 is received in a transverse bore 169C in the pan 168. Appropriate adhesive 170 is contained in the pan 168, and the lower portion of the roll 124 dips into the adhesive 170 so that adhesive is picked up by the roll 124 as the roll 124 rotates. A rectangular guard 170A is attached to an upper edge of the pan 168. An apropriate heater element 171 is attached to a bottom face 172 of the pan 168.

The roll 124 is caused to turn by spur gear 173 mounted on the stub shaft portion 154 (see FIG. 1). The spur gear 173 is driven by a pinion 174 (FIGS. 3 and 10), which is rotatably mounted on a stub shaft 176. The stub shaft 176 is mounted on the side plate 12. The pinion 174 is driven by a sprocket 177, which is driven by a chain 178 (FIG. 3). The chain 178 is driven by a sprocket 179 rotatably mounted on the transverse rod 19. The sprocket 179 is driven by a pinion 181, which meshes with a spur gear 182 mounted on the shaft 58.

The adhesive applying roll 124 (FIG. 4) is driven counterclockwise as shown in FIG. 4 and applies adhesive to a lower face of the sheet as the sheet is fed thereagainst. The sheet is held against the roll 124 by an upper roll 183. Stub shaft portions 183A (FIG. 1) and 183B of the upper roll 183 are rotatably mounted in bearing blocks 184 and 186 (FIG. 2). The bearing blocks 184 and 186 are rotatably mounted on the cross rod 163. Adjustment screws 187 and 188 (FIG. 1) threaded in the bearing blocks 184 and 186 engage the bearing blocks 156 and 157, respectively, to hold the upper roll 183 parallel to and spaced above the roll 124 sufficiently to permit the sheet to pass between the roll 124 and the upper roll 183. A pinion 191 (FIG. 3) mounted on the stub shaft portion 183B drives the upper roll 183. The pinion 191 meshes with the spur gear 173 to drive the upper roll 183. The sheet is stripped from the roll 124 after passing under the upper roll 183 by sheet stripping members 193, which are rotatably mounted on the cross rod 163. Spacer rings 194 separate the sheet stripping members 193.

The machine illustrated in the drawings and described above is subject to structural modification without departing from the spirit and scope of the appended claims.

What is claimed is:

1. A machine for trimming edges from a sheet of copy and for applying adhesive to a back face of the sheet which comprises a rotatably mounted backup roll, means for guiding the sheet to the backup roll, knife means in cutting relation to the backup roll, means for turning the backup roll to cause the sheet to be drawn between the knife means and the backup roll to trim the sheet, guide receiving the trimmed sheet from the backup roll, an adhesive applying roll, an adhesive pan underlying the adhesive applying roll, means for turning the adhesive applying roll to cause a lower portion of the adhesive applying roll to dip into adhesive in the adhesive pan to pick up adhesive, and a metering blade in adhesive metering relation to the adhesive applying roll, the guide discharging the trimmed sheet onto the metering blade, the metering blade directing the sheet to the adhesive applying roll so that the trimmed sheet receives adhesive on a back face thereof.

2. A machine as in claim 1 wherein an upper edge portion of the guide rests on the backup roll and a lower edge portion of the guide rests on the metering blade.

3. A machine as in claim 2 wherein the metering blade is mounted for up and down movement, the machine includes means for moving the blade up and down with respect to the adhesive applying roll, and the lower edge portion of the guide moves up and down with the metering blade.

4. A machine as in claim 2 wherein the guide includes a lower plate, an upper plate, and means for holding the upper and lower plates in spaced substantially parallel relation, the face of the backup roll travels downwardly from the knives, the machine includes means for holding the guide with the upper edge of the lower plate resting on the downwardly moving portion of the backup roll above the axis thereof, the lower plate slopes downwardly from the backup roll, the lower edge of the lower plate rests on an upper face of the metering blade, and the upper face of the metering blade is substantially horizontal.

5. A machine as in claim 3 wherein the machine includes spaced side plates, the backup roll being rotatably mounted between the side plates, upright track means in each of the side plates adjacent the backup roll, and a pair of track followers mounted on the guide, each of the track followers being guided by one of the track means to hold the upper edge portion of the guide in position for resting on the backup roll.

6. A machine for trimming edges from a sheet of copy and for applying adhesive to a back face of the sheet which comprises a pair of spaced side plates, a backup roll rotatably mounted between the side plates, means for guiding the sheet to the backup roll, knife means in cutting relation to the backup roll, means for turning the backup roll to cause the sheet to be drawn between the knife means and the backup roll to trim the sheet, a guide receiving the trimmed sheet from the backup roll, an adhesive applying roll, an adhesive pan underlying the adhesive applying roll, means for turning the adhesive applying roll to cause a lower portion of the adhesive applying roll to dip into adhesive in the adhesive pan to pick up adhesive, a metering blade in adhesive metering relation to the adhesive applying roll, the guide discharging the trimmed sheet onto the metering blade, the metering blade directing the sheet to the adhesive applying roll so that the trimmed sheet receives adhesive on a back face thereof, a pair of blade support members, each of the blade support members being carried by the metering blade and extending outwardly of one of the side plates through an opening in the associated side plate, a hanger support mounted on an outer face of each of the side plates, a hanger member linking each of the hanger supports and an associated one of the blade support members, and means for varying the spacing between the hanger supports and the blade support members for raising and lowering the metering blade.

7. A machine as in claim 6 wherein each of the hanger members is rotatably mounted in the associated hanger support and is in threaded relation with the associated blade support member, and the means for varying the spacing between the hanger support and the blade support members includes means for turning the hanger members for raising and lowering the metering blade.

* * * * *